US006464094B2

(12) United States Patent
Zacharias

(10) Patent No.: US 6,464,094 B2
(45) Date of Patent: Oct. 15, 2002

(54) STAND-BY TANK FOR REMOTE ACCESS FIRE SUPPRESSION

(76) Inventor: George Zacharias, R.R. #1, S 17B, Comp 4, Burns Lake (CA), V0S 1EO ( * ) Notice: Subject to any disclaimer, the term of this patent is extended or adjusted under 35 U.S.C. 154(b) by 0 days.

(21) Appl. No.: 09/883,932

(22) Filed: Jun. 20, 2001

(65) Prior Publication Data

US 2002/0020704 A1 Feb. 21, 2002

Related U.S. Application Data

(60) Provisional application No. 60/214,739, filed on Jun. 29, 2000.

(30) Foreign Application Priority Data

Jun. 29, 2000 (CA) ..... 2313179

(51) Int. Cl.[7] ..... B65D 19/00

(52) U.S. Cl. ..... 220/4.12; 220/562; 220/565

(58) Field of Search ..... 220/4.12, 4.13, 220/565, 567.2, 1.5, 562, 564

(56) References Cited

U.S. PATENT DOCUMENTS

| | | | | | |
|---|---|---|---|---|---|
| 1,466,175 | A | * | 8/1923 | Kramer | 220/562 |
| 1,557,565 | A | * | 10/1925 | Davis, Jr. | 220/562 |
| 1,595,633 | A | * | 8/1926 | Thwaits | 220/564 |
| 3,220,482 | A | | 11/1965 | Eveleth | |
| 3,251,500 | A | * | 5/1966 | Archbold | 220/562 |
| 3,650,501 | A | * | 3/1972 | Streb | 220/565 X |
| 3,831,849 | A | | 8/1974 | Studinger | |
| 4,065,022 | A | * | 12/1977 | Cainaud | 220/565 X |
| 4,488,603 | A | | 12/1984 | Schmittmann et al. | |
| 4,729,434 | A | | 3/1988 | Rohrbach | |
| 5,009,244 | A | | 4/1991 | Grindley et al. | |
| 5,385,233 | A | | 1/1995 | McKibben et al. | |
| 5,779,078 | A | * | 7/1998 | Reddy | 220/562 X |
| 5,884,709 | A | * | 3/1999 | Evans et al. | 220/565 X |
| 5,909,775 | A | | 6/1999 | Grindley | |
| 6,158,521 | A | | 12/2000 | Klump | |

FOREIGN PATENT DOCUMENTS

| | | |
|---|---|---|
| GB | 2034181 A | 6/1980 |
| JP | 9308701 | 12/1997 |

* cited by examiner

*Primary Examiner*—Steven Pollard
(74) *Attorney, Agent, or Firm*—Antony C. Edwards

(57) ABSTRACT

A stand-by water tank for remote access fine suppression is adapted to be transportable to the fire by grappling of the tank about its balance point by a skidder grapple.

8 Claims, 2 Drawing Sheets

STAND-BY TANK FOR REMOTE ACCESS FIRE SUPPRESSION

CROSS REFERENCE TO RELATED APPLICATION

This application claims priority from U.S. Provisional Patent Application No. 60/214,739 filed Jun. 29, 2000 entitled Stand-By Tank For Remote Access Fire Suppression, and from Canadian Patent Application No. 2,313,179 filed Jun. 29, 2000.

FIELD OF THE INVENTION

This invention relates to a self contained water tank, primarily for use in fire suppression activities within an area of active timber harvesting, which can be quickly transported by such timber harvesting equipment as a grapple skidder, over rough terrain where road access is generally unavailable.

BACKGROUND OF THE INVENTION

Much of the activity surrounding timber harvesting are concerned with minimizing the potential fire risk in an area of abundant natural combustible fuel. In most commercial operations the act of felling, bucking, skidding and transportation are hot activities relying on engines utilizing flammable fuels with the associated high risk of accidental fire.

Containment of the initial fire in a forested area depends upon the availability of an adequate stand-by water supply, to douse the fire and surrounding forest litter and to ensure that embers do not re-ignite immediately thereafter.

The need, then, for an adequate supply of water, on stand-by, for fire suppression activities in areas where timber harvesting is active is self evident, especially where such supply of water is within a tank and therefore, readily transportable by a grapple skidder over generally rough terrain which may be blocked by logging debris.

It is, then, an object of the present invention to provide a stand-by water tank which is suitably constructed so as to be readily transportable by a grapple skidder or other similar piece of logging equipment, over rough terrain to the site of a fire.

It is a further object of the present invention to provide a stand-by water tank which is a self contained unit having mounted and stored thereon pumping apparatus and a supply of fuel. The pump preferably being a 'two way' pump, which is capable of either discharging water under pressure from the tank, or from an alternative water source or for refilling the tank. Further it is an object of this invention to provide a stand-by tank, which, in an alternative embodiment may be used as a fuel storage tank.

SUMMARY OF THE INVENTION

In summary the stand-by tank for remote access fire suppression is a tank which is manufactured, for example, from ⅜ inch steel, so as to be readily transportable by a grapple skidder or like forest harvesting equipment.

The tank has an elongated generally cylindrically shaped metal body section having first and second ends, which enclose an interior cavity which may be filled with a fire suppressing liquid such a water. The first end of the tank has attached thereto near the lowest point a drain pipe and a suitable closure cap. Supports on the bottom surface of the tank provide stability to the tank when placed upon the ground and permit sufficient clearance between the bottom of the tank and the ground to permit the grapple of the skidder to close tightly around the tank.

The top portion of the tank, intermediate the first and second ends, has a sturdy metal saddle on which the skidder grapple rests and which aligns the skidder grapple with the point of balance of the tank. Welded to the inner surface of the tank in general alignment with the saddle is a reinforcing collar or other suitable means which will prevent compressive deformation of the stand-by tank by the grapple, when the tank is gripped and lifted by the grapple of the skidder.

A compartmentalized storage container with closable lid, is positioned on the top portion of the tank near the first end. This container holds a pump in one compartment and in the other holds a container of fuel for the pump and lengths of suction and discharge hose.

The pump is a two-way suction and discharge type installed on the standby tank in a manner that will permit water to be drawn either from the tank or from an alternative water source and discharged under pressure at a fire, or from an alternative source such as a tank truck to refill the tank.

A filling pipe and suitable closure are located on the top portion of the tank near the second end. This fill pipe is of a diameter that will prevent the coupling end of the suction hose from passing through so that the suction hose may be left within the standby tank during times of transport or storage.

A stabilizing loop or chain is positioned at the second end of the tank adjacent the filling pipe. Where the grapple skidder has a winch, the cable from the winch is connected to this loop to prevent the tank from swinging as the skidder traverses uneven ground.

It is anticipated that the tank may be readily adapted for the storage and transportation of fuel to areas under active timber harvesting where access is unsuitable for conventional vehicles.

In an alternative embodiment of this invention, the stand-by tank may be adapted to contain, in a separate storage compartment, a concentrated water based fire suppression/retardant compounds such as foam. The storage compartment is directly connected to the suction inlet port of the pump for a metered supply of foam into the water stream being pumped onto the fire.

In summary, the five suppression tank of the present invention includes a hollow thin-walled elongate container having first and second opposite ends. The container is seeded for containing water. The container has a balance point generally mid-way along its length about which point the container is balanced when at least partially filled with water. Wall reinforcement for reinforcing walls of the container is mounted to the container at the balance point. The reinforcement bears the compressive force of a grapple when grappling the container. The grapple is an actuable grapple on an actuable arm of a logging vehicle.

In the preferred embodiment the container is metal and the wall reinforcement is a metal collar mounted annularly and laterally around the walls of the container. A saddle may be mounted to the collar for aligning the grapple onto the collar and for bearing of the grapple against the saddle.

In one embodiment a sealing baffle is mounted in one end of the first and second ends of the container so as to form a water-tight compartment for mounting water pumps therein. A door provides access to the compartment.

An auxiliary storage tank may be mounted to the container walls for storage of five suppression foam therein. The auxiliary storage tank has a conduit mountable into fluid communication with said pumps for in-line addition of the foam to the water in the container as the water is pumped from the container. The auxiliary storage tank may be mounted within the container and may be accessible through a resealable aperture in the walls of the container.

In a further embodiment, storage housing is mounted onto the container for housing a pump therein in fluid communication with the container so that the pump may pump the water from the container. The housing may be mounted on the outside of the container.

Advantageously, the container is cylindrical and rigid feet are mounted to the underside of the container. The feet support the container when resting on the ground and for elevating the balance point of the container above the ground so that the grapple may clamp the container laterally around the container at the balance point.

DETAILED DESCRIPTION OF PREFERRED EMBODIMENTS

Figure 1:
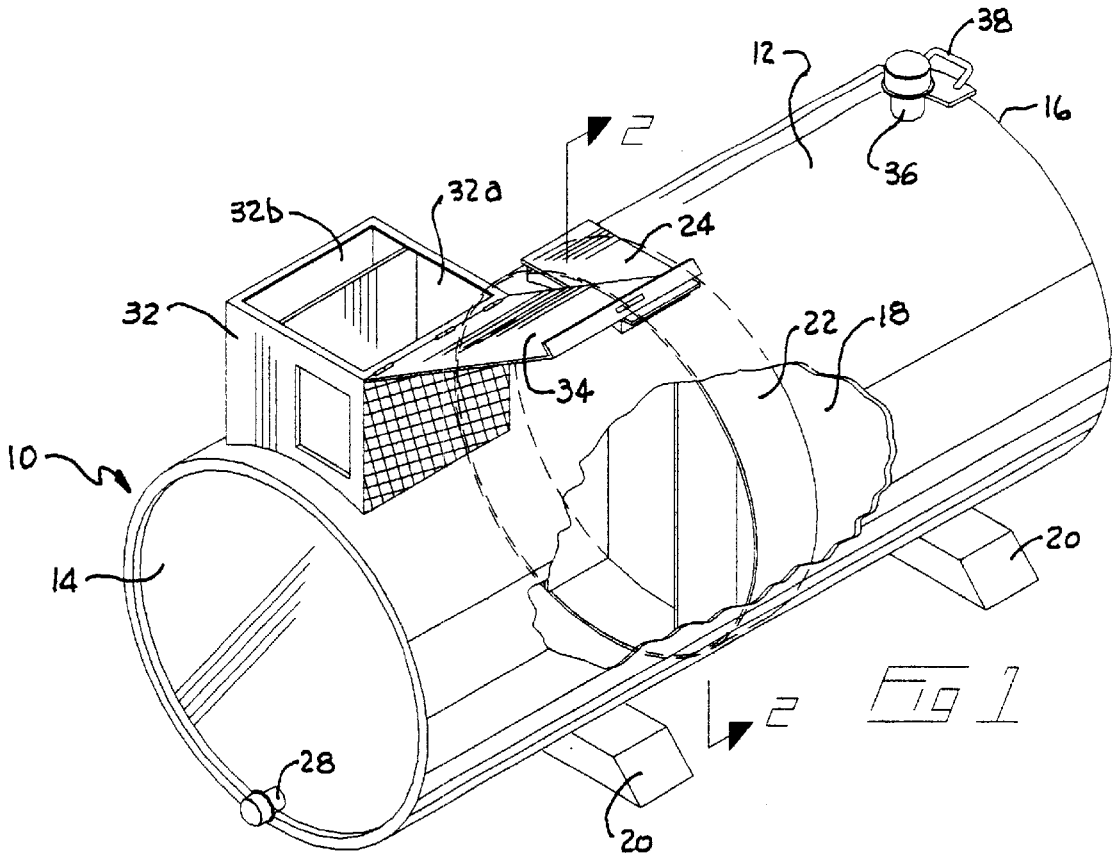
FIG. 1 is a partially cut-away perspective view of the tank of the present invention.
Figure 2:
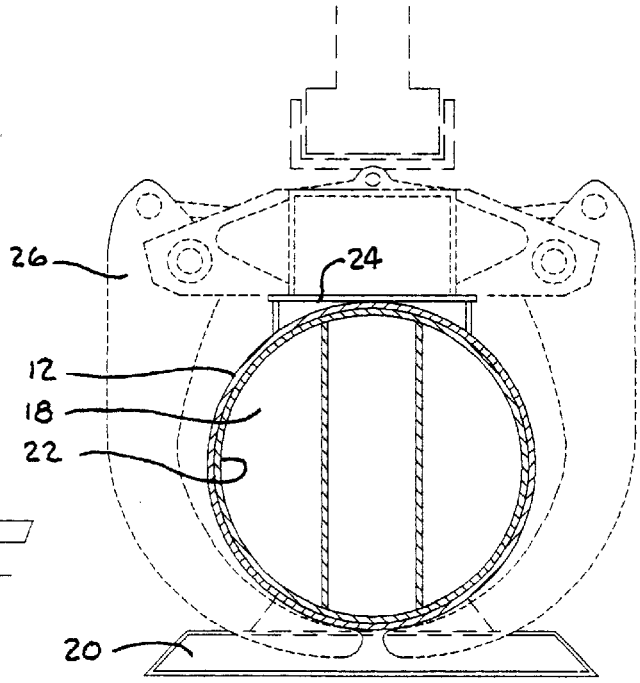
FIG. 2 is a sectional view taken on line 2—2 of FIG. 1.

As illustrated in the accompanying Figures the stand-by tank 10 of the present invention has an elongated cylindrical body 12 which is manufactured from ⅜ inch steel or other suitable materials which will withstand the rough usage associated with the intended use. Cylindrical body 12 has opposite ends 14 and 16 which are suitably attached to body 12, such as by welding, and form an internal cavity 18. Tank 10 is provided with supports 20 on its bottom surface to provide stability for the tank when placed upon the ground. A reinforcing collar 22 is welded to the inner surface of tank 10 and a saddle 24, positioned in general alignment with collar 22, is attached to the top exterior surface of tank 10. End 14 of the tank has attached thereto near the lowest point a drain pipe 28 with a suitable closure cap.

A compartmentalized storage container 32 with closable lid 34, is secured to the top portion of the tank near end 14 and has a large compartment 32*a* which will hold a pump (not shown) and a smaller compartment 32*b* suitable for holding fuel for the pump and lengths of suction and discharge hose (not shown).

A filling pipe 36 and suitable closure are located on the top portion near end 16 of tank 10 and adjacent thereto is a stabilizing loop or chain 38.

As the tank 10 is gripped by the grapple 26 of the skidder, grapple 26 contacts saddle 24 which aligns the skidder grapple 26 with the point of balance of the tank and the internal reinforcing collar 22. Collar 22, or other suitable means, will prevent compressive deformation of the body 12 of stand-by tank 10 by grapple 26 while supports 20 on the bottom surface of tank 10 permit sufficient clearance between the bottom of the tank and the ground surface to permit grapple 26 to close tightly around the tank 10. Where the skidder has a winch, a cable can be fastened to stabilizing loop or chain 38 and by tensioning the winch cable the standby tank can be prevented from swinging laterally during transportation over uneven terrain.

Figure 3:
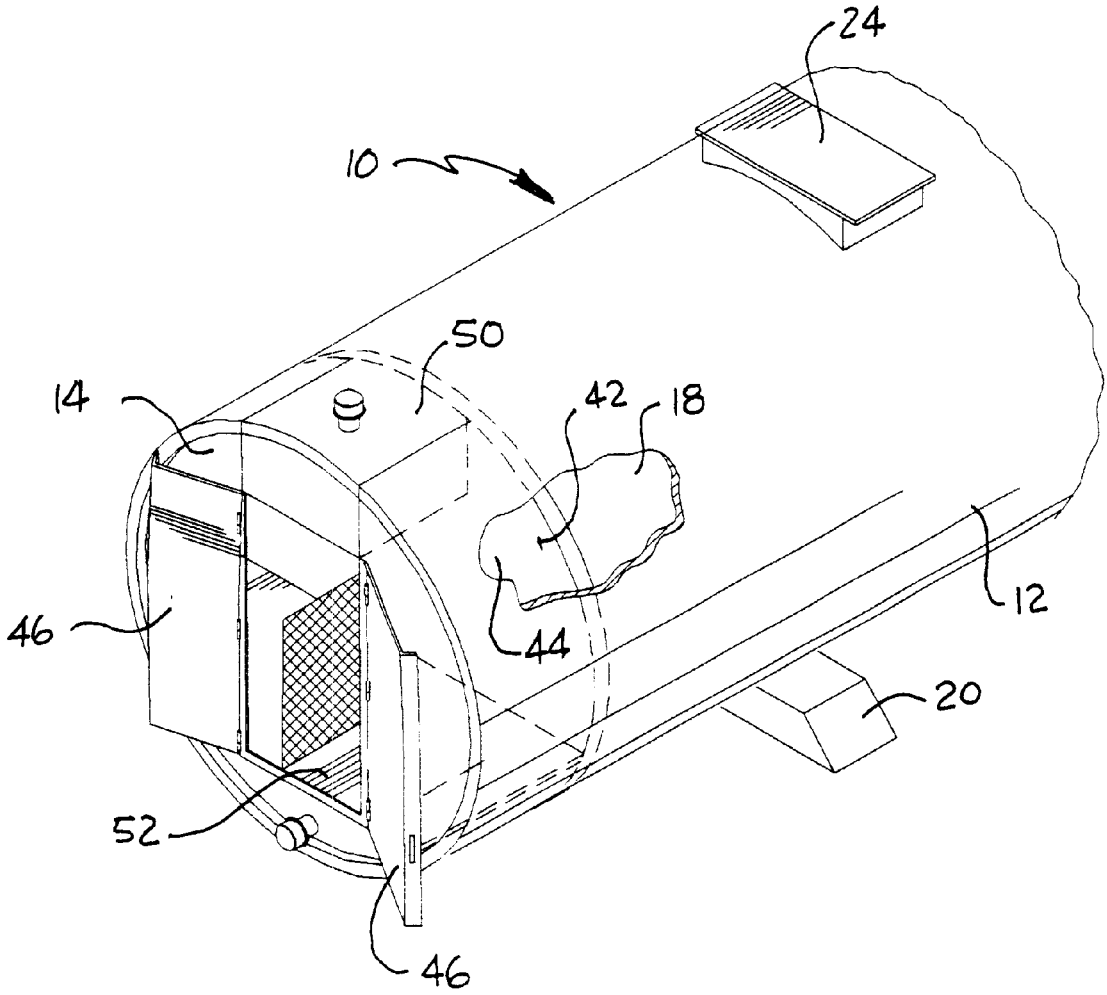
FIG. 3 is a partial perspective view of a modified form of the tank.

As may be seen by referring to FIG. 3, where a water based fire suppression compound such as in a foam concentrate form is to be added to the discharge water stream from the pump, stand-by tank 10 may be provided with an interior sealed baffle 42 rigidly mounted internally near end 14. Baffle 42 forms a water tight compartment 44 between cavity 18 and end 14. The compartment 44 at end 14 is accessed through doors 46. A storage tank 50 is mounted, such as by welding, adjacent the top portion of compartment 44. A floor 52 may be provided near the bottom surface. Floor 52 is compartmentalized similar to container 32 for the storage of a pump in one compartment and fuel and hoses for the pump in the other. A conduit (not shown) connects tank 50 to the suction inlet port of a pump (also not shown). Fire suppressions foam concentrate is stored in storage tank 50. Operation of the pump imparts a continuous metered quantity of fire suppression foam to the water stream from the pump to more efficiently combat and suppress a fire.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A fire suppression tank comprising:

(a) a hollow thin-walled elongate container having first and second opposite ends, said container sealed for containing water, said container having a balance point generally mid-way along its length about which point said container is balanced when at least partially filled with water, (b) wall reinforcement for reinforcing walls of the container mounted to said container at said balance point so as to bear a compressive force of a grapple when grappling said container, the grapple an actuable grapple on an actuable arm of a logging vehicle, wherein said container is cylindrical and wherein rigid feet are mounted to an underside of said container for supporting said container when resting on the ground and for elevating said balance point above said ground so that the grapple may clamp said container laterally around said container at said balance point, wherein said container is metal and said wall reinforcement is a metal collar mounted annularly laterally around said walls of said container, further comprising a saddle mounted above and to said collar and a top exterior surface of said walls of said container, said saddle adapted for aligning the grapple onto said collar and for bearing of the grapple against said saddle.

2. The tank of claim 1 wherein said saddle includes a substantially flat plate mounted laterally across said top exterior surface.

3. The tank of claim 2 wherein a sealing baffle is mounted in one end of said first and second ends of said container so as to form a water-tight compartment in the one end, a door in said one end providing access to said compartment for mounting a water pump therein.

4. The tank of claim 3 wherein an auxiliary storage tank is mounted to said container walls for storage of fire suppression foam therein, said auxiliary storage tank having a conduit mountable into fluid communication with said pump for in-line addition of said foam to said water in the container as the water is pumped from said container.

5. The tank of claim 4 wherein said auxiliary storage tank is mounted within said container and is accessible through a resealable aperture in said walls of said container.

6. The tank of claim 2 wherein a storage housing is mounted onto said container for housing a pump therein in fluid communication with said container so that said pump may pump said water from said container.

7. The tank of claim 6 wherein said housing is mounted on the outside of said container.

8. The tank of claim 2 wherein said plate is rectangular so as to extend its length aligned along said collar.

* * * * *